US005828217A

United States Patent [19]

Inagaki et al.

[11] Patent Number: 5,828,217

[45] Date of Patent: Oct. 27, 1998

[54] MISFIRE DETECTING DEVICE FOR INTERNAL COMBUSTION ENGINE

[75] Inventors: Hiroshi Inagaki, Komaki; Kanehisa Kitsukawa, Konan, both of Japan

[73] Assignee: NGK Spark Plug Co., Ltd., Nagoya, Japan

[21] Appl. No.: 567,992

[22] Filed: Dec. 4, 1995

[30] Foreign Application Priority Data

Dec. 2, 1994 [JP] Japan ..... 6-329535

[51] Int. Cl.[6] ..... F02P 17/00

[52] U.S. Cl. ..... 324/393; 123/627

[58] Field of Search ..... 324/393, 388, 324/399; 73/118; 123/627, 655, 630

[56] References Cited

U.S. PATENT DOCUMENTS

| | | | |
|---|---|---|---|
| 2,926,301 | 2/1960 | Westberg et al. | 324/399 |
| 4,156,839 | 5/1979 | Nakagawa | 324/15 |
| 5,216,369 | 6/1993 | Toyama | 324/388 |
| 5,237,278 | 8/1993 | Bumen | 324/388 |
| 5,365,910 | 11/1994 | Miyata et al. | 73/116 |
| 5,396,176 | 3/1995 | Ishii et al. | 324/388 |
| 5,424,647 | 6/1995 | Ohsawa | 324/399 |
| 5,503,132 | 4/1996 | Miyata et al. | 123/630 |

FOREIGN PATENT DOCUMENTS

| | | |
|---|---|---|
| 62-249051 | 4/1988 | Japan . |
| 4-339176 | 11/1992 | Japan . |

*Primary Examiner*—Vinh P. Nguyen
*Assistant Examiner*—Thomas Valone
*Attorney, Agent, or Firm*—Foley & Lardner

[57] ABSTRACT

A misfire detecting device for an internal combustion engine having a double-ended or single-ended distributorless ignition system is provided. The device comprises a first capacitor connected to a secondary winding side of a spark plug and in parallel to the spark plug, the first capacitor being charged by a voltage produced at a secondary winding side of an ignition coil and thereafter applying a voltage to the spark plug when a voltage at the secondary winding side drops, a second capacitor connected in series with the first capacitor and having a capacitance larger than that of the first capacitor to divide a voltage across the first capacitor, and a misfire detecting unit connected to a junction between the first capacitor and the second capacitor to detect a misfire on the basis of a decay characteristic of a divided voltage produced at the second capacitor.

17 Claims, 15 Drawing Sheets

AT THE TIME OF NORMAL COMBUSTION

AT THE TIME OF MISFIRE

MISFIRE DETECTING DEVICE FOR INTERNAL COMBUSTION ENGINE

BACKGROUND OF THE INVENTION

1. Field of the Invention

The present invention relates to a device for detecting a combustion condition or misfire of each cylinder of an internal combustion engine having an ignition system.

2. Description of the Prior Art

From the demand for purification of the exhaust gases and improvement in fuel consumption of an automotive engine, it has been required a device which is capable of detecting an ignition condition of an internal combustion engine for thereby preventing misfires of all the cylinders. This kind of device is disclosed in Japanese patent provisional publication No. 62-249051. This device will be described with reference to FIG. 12. A high voltage induced in the ignition coil 2 is applied to the spark plug 3 to cause spark discharge and combustion of the mixture within a cylinder (not shown), while being stored in the capacitor 8 with the polarity shown. In this connection, when the mixture is combusted and ions are produced, current flows through a closed circuit consisting of the spark plug 3, diode 13, capacitor 8 and the resistor 6, so that the ionic current within the cylinder can be detected at the output terminal 7.

This method has a problem that it is easily affected by noise since the ion concentration within the cylinder is detected based on the current flowing through the resistor 8. That is, the CPU (central processing unit) for control of an engine is adapted to judge, through detection of the voltage across the output terminal at a predetermined interrupt time, whether normal combustion has taken place or not at the corresponding cylinder. However, if a noise is caused in a circuit line due to spark discharge at another cylinder at that interrupt time, an erroneous judgment may be made. For this reason, it has been proposed by Japanese patent provisional publication No. 4-339176 which is assigned to the same assignee of this application, a misfire detecting device which accounts for an erroneous operation due to noise.

Referring to FIGS. 13, 14A, 14B, and 14C the misfire detecting device proposed by Japanese patent provisional publication No. 4-339176 will be described. FIG. 13 shows the electric circuit of the misfire detecting device, and FIGS. 14A and 14B the waveforms of voltages at various portions of the misfire detecting device (i.e., at the circuit portions indicated by ①, ③ and ④ in FIG. 13). As shown in FIG. 13, a primary current interrupting means 22 produces a pulse "a" (refer to section ① of FIGS. 14A and 14B, which depicts the waveforms of voltages at the circuit portion ① in FIG. 13) at a predetermined timing to switch the transistor 24 on or off. By this, current flowing through the ignition coil 26 is interrupted and a peak voltage "p" (refer to section ③ of FIGS. 14A and 14B, which depicts the waveforms of voltages at the circuit portion ③ in FIG. 13) is produced. The peak voltage "p" is distributed through the distributor 12 to each spark plugs 52 to 55 to cause them to fire or perform spark discharge. The primary current interrupting means 22 produces a pulse "b" (refer to section ① of FIG. 14A) at a predetermined timing and produces an electrical potential "s" for detection of a misfire in the ignition coil 26. The electrical potentials "s", when applied to the spark plugs 52 to 55, have different decay waveforms depending upon whether normal combustion has taken place or a misfire has occurred. That is, when normal ignition has taken place, ions are produced so that the charge applied to the spark plugs 52 to 55 is discharged by way of the ions and decays rapidly (refer to the waveform "s2" of section ④ of FIGS. 14A and 14B, which depicts the waveforms of voltages at the circuit portion ④ in FIG. 13). On the other hand, when a misfire has taken place, there is not produced any ion so that the charge applied to the spark plugs 52 to 55 is not discharged and decays gradually (refer to "s1" of section ④ of FIGS. 14A and 14B). By detecting the decay waveform of the charge by means of a sensor 14 formed from dielectric and dividing the charge at the capacitor 144, judgment on whether a misfire has occurred or not is made at the misfire judging circuit 149.

In the case of the misfire detecting device shown in FIG. 13, there is no such current flowing through the resistor 6 as in the misfire detecting device of FIG. 12 but judgment on misfire is made on the basis of the electrical potential at the capacitor 144 which corresponds to an integrated value of the current so that an erroneous operation due to noise is hard to occur. For this reason, even if noise is caused in a circuit line, the misfire detecting device is hard to effect an erroneous operation and thus has been suitably used in an internal combustion engine having a single-ended distributor type ignition system or the like.

On the other hand, it has nowadays been required to manufacture automotive multi-cylinder engines at low cost. To this end, a double-ended distributorless ignition system shown in FIG. 15 has come to be employed. In the double-ended distributorless ignition system which may be called a double-explosion or double-ignition system, there is not used any distributor but one transistor 24 and one ignition coil 26 are used for making the spark plug 52, which is connected at the center electrode side to the positive side of the secondary winding of the ignition coil 26 and grounded at the outer electrode side, and the spark plug 54, which is connected at the center electrode side to the negative side of the secondary winding and grounded at the outer electrode side, perform spark discharge for firing two cylinders. In this double-ended distributorless ignition system, a distributor which is a mechanical rotating portion in the system is not used, so this system has an advantage that it is higher in reliability as compared with a single-ended distributor ignition system shown by way of example in FIG. 13 and cheaper as compared with a single-ended distributorless ignition system having a transistor and ignition coil for each cylinder as shown by way of example in FIG. 12.

However, it was revealed by the experiment conducted by the applicant that the misfire detecting device shown in FIGS. 12 and 13, when applied to the double-ended distributorless ignition system, was incapable of detecting a misfire correctly. That is, in the case of the misfire detecting device of FIG. 13, a positive potential is applied to the spark plugs 52 to 55 so that the positive charge is discharged by way of the ions caused at the time of ignition or firing to obtain the decay waveform depicted by "s2" in FIG. 14A. In this instance, due to a large difference from the decay waveform depicted by "s1" in FIG. 14A, it was possible to distinguish misfire from combustion. However, when the above described misfire detecting method was applied to the positive side spark plug 52 and the negative side spark plug 54 of the double-ended distributorless ignition system shown in FIG. 15, the above described decay waveform "s2" could be obtained at the time of combustion on the positive spark plug 52 side to which the positive potential is applied, whereas a gradual decay waveform depicted by "s3" in FIG. 14C was obtained even at the time of combustion on the negative spark plug 54 side to which the negative potential is applied (in the meantime, please note that in FIG. 14C the positive side and negative side are reversed only for convenience of comparison), which decay waveform "s3" did not differ so much from the decay waveform "s1" obtained at the time of misfire, so there was a difficulty in making a judgment on whether a misfire had occurred or not. In the meantime, the reason why the decay waveform "s1" obtained in the case where a positive charge is applied to the ions differs from that obtained in the case where a negative charge is applied to the ions is that in the case where a positive charge is applied to a spark plug, discharge occurs across the center electrode and the outer electrode by way of the electrons in the ions, while on the other hand in the case where a negative charge is applied to a spark plug, discharge occurs across the center electrode and the outer electrode by way of positive ions each of which is heavier than an electron, so the positive ion is lower in moving speed as compared with the above described electron.

SUMMARY OF THE INVENTION

According to an aspect of the present invention, there is provided a misfire detecting device for an internal combustion engine having an ignition coil 26 having a primary winding 26*c* and a secondary winding 26*d,* primary current interrupting means 22 for interrupting flow of battery current through the primary winding 26*c* of the ignition coil 26, and a spark plug 52 connected at a center electrode side to a positive side of the secondary winding 26*d* of the ignition coil 26 and grounded at an outer electrode side. The misfire detecting device comprises a first capacitor 42 connected to a secondary winding 26*d* side of the ignition coil 26 and in parallel to the spark plug 52, the first capacitor 42 being charged by a voltage produced at the secondary winding 26*d* side of the ignition coil 26 and thereafter applying a voltage to the spark plug 52 when a voltage at the secondary winding 26*d* side drops, a second capacitor 44 connected in series with the first capacitor 42 and having a capacitance larger than that of the first capacitor 42 to divide a voltage across the first capacitor 42, and misfire detecting means 49 connected to a junction between the first capacitor 42 and the second capacitor 44 to detect a misfire on the basis of a decay characteristic of a divided voltage produced at the second capacitor 44. In the misfire detecting device structured as above, when the primary current interrupting means 22 supplies current to the ignition coil 26, a high voltage is induced at the secondary winding side. The high voltage is applied to the spark plug 52 to make it perform spark discharge and stored in the first capacitor 42 connected in parallel with the spark plug 52. When the voltage at the secondary winding 26*d* side drops, the first capacitor 42 applies a voltage to the spark plug 52 having finished spark discharge. In the case where normal combustion has taken place within a cylinder provided with the spark plug 52, the voltage applied to the spark plug 52 decays since current flows between the center electrode and the outer electrode by the effect of ions produced at the time of combustion. The second capacitor 44 connected in series with the first capacitor 42 divides the voltage across the first capacitor 42 that applies a charge to the spark plug 52. On the basis of the decay characteristic of the divided voltage produced at the second capacitor 44, the misfire detecting means 49 detects that normal combustion has taken place within the cylinder. On the other hand, in the case where normal combustion has not taken place within the cylinder, the voltage applied to the above described spark plug 52 is maintained at a substantially constant value since ions are not produced when normal combustion is not performed within the cylinder and current does not flow between the center electrode and the outer electrode. The second capacitor 44 divides the voltage across the first capacitor 42 that applies a charge to the spark plug 52. On the basis of the decay characteristic of the divided voltage produced at the second capacitor 44, i.e., on the basis of the fact that the decay is gradual, the misfire detecting means 49 detects that normal combustion has not taken place within the cylinder.

According to another aspect of the present invention, the misfire detecting device further comprises a first resistor 32 interposed between a line 27 connecting between the ignition coil 26 and the spark plug 52, and the first capacitor 42. By this, the high voltage produced at the secondary side of the ignition coil 26 is stored in the first capacitor 42 by way of the first resistor 32. Due to this, by adjusting the resistance of the first resistor 32 and thereby limiting the amount of charge of the first capacitor 42, the voltage which the first capacitor 42 applies to the spark plug 52 having finished spark discharge can be set to a desired value.

Alternatively, the first resistor 32 can be interposed between the first capacitor 42 and the second capacitor 44. By this, the high voltage produced at the secondary side of the ignition coil 26 is stored in the first capacitor 42 under the influence of a time constant circuit constituted by the first capacitor 42 and the first resistor 32. Due to this, by adjusting the resistance of the first resistor 32 and thereby limiting the amount of charge of the first capacitor 42, the voltage which the first capacitor 42 applies to the spark plug 52 having finished spark discharge can be set to a desired value.

According to a further aspect of the present invention, the misfire detecting device further comprises a diode 34 connected in parallel with the first resistor 32 and in such a manner as to have an anode connected to the first capacitor 42. By this, the high voltage induced at the secondary winding side of the ignition coil 26 is applied to the diode 34 in the reverse direction thereof and stored in the first capacitor 42 by way of the first resistor 32. On the other hand, the charge stored in the first capacitor 42 passes the diode 34 in the forward direction thereof and thus flows to the spark plug 52 without passing through the above described first resistor 32. Due to this, adjustment of the resistance of the first resistor 32 does not cause any influence to current at the time of discharge or firing, so the resistance of the first resistor 32 can be adjusted freely.

Alternatively, the diode 34 can be connected in parallel with the first resistor 32 and in such a manner as to have a cathode connected to the first capacitor 42. By this, substantially the same effect as above can be obtained.

According to a further aspect of the present invention, the misfire detecting device further comprises a second resistor 36 interposed between the connecting line 27 and the first capacitor 42 or between the first capacitor 42 and the second capacitor 44. By the second resistor 36 disposed in series with the diode 34, even if the diode 34 is shorted, the high voltage produced at the secondary side of the ignition coil 26 is applied to the first capacitor 42 by way of the second resistor 36 so that breakdown of the first capacitor 42 never occurs.

According to a further aspect of the present invention, there is provided a misfire detecting device for an internal combustion engine provided with a double-ended distributorless ignition system. The ignition system has an ignition coil 26 having a primary wiring 26*c* and a secondary wiring 26*d,* primary current interrupting means 22 for interrupting flow of battery current through the primary winding 26*c* of the ignition coil 26, a first spark plug 52 connected at a center electrode side to a positive side of the secondary winding 26*d* and grounded at an outer electrode side, and a second spark plug 54 connected at a center electrode side to a negative side of the secondary winding 26*f* and grounded at an outer electrode side. The misfire detecting device comprises a first capacitor 42 connected to a positive side of the secondary winding 26*d* of the ignition coil 26 and in parallel with the spark plug 26, the first capacitor 42 being charged by a voltage produced at the secondary winding 26*d* side of the ignition coil 26 and thereafter applying a voltage to the first and second spark plugs 52 and 54 when a voltage at the secondary winding 26*d* side drops, a second capacitor 44 connected in series with the first capacitor 42 and having a capacitance larger than that of the first capacitor 42 to divide a voltage across the first capacitor 42, and misfire detecting means connected to a junction between the first capacitor and the second capacitor to detect a misfire on the basis of a decay characteristic of a divided voltage produced at the second capacitor 44. In the misfire detecting device structured as above, when the primary current interrupting means 22 supplies current to the ignition coil 26, a high voltage is induced at the secondary winding side. The high voltage is applied to the first and second spark plugs 52 and 54 to make it perform spark discharge whilst being stored in the first capacitor 42 connected in parallel with the spark plug 52. When the voltage at the secondary winding 26*d* side drops, the first capacitor 44 applies a voltage to the first and second spark plugs 52 having finished spark discharge. In the case where normal combustion has taken place within the cylinder provided with the first spark plug 52, the voltage applied to the first spark plug 52 is caused to decay since current flows between the center electrode and the outer electrode by the effect of ions produced at the time of combustion. In this instance, the cylinder provided with the second spark plug 54 is on exhaust stroke and ions are not produced, so current does not flow between the center electrode and the outer electrode and therefore the second spark plug 54 does not cause any influence to the decay of voltage. On the contrary, in the case where the cylinder provided with the second spark plug 54 is on power stroke and normal combustion has taken place within the cylinder, current flows between the center electrode and the outer electrode of the second spark plug 54 by the effect of ions produced at the time of combustion and the voltage is caused to drop. In this instance, the cylinder provided with the first spark plug 52 is on exhaust stroke and ions do not exist, so current does not flow between the center electrode and the outer electrode of the first spark plug 52 and therefore the first spark plug 52 does not cause any influence to the decay of voltage. The second capacitor 44 connected in series with the first capacitor 42 divides the voltage across the first capacitor 42 that applies a charge to the first and second spark plugs 52 and 54. On the basis of the decay characteristic of the divided voltage produced at the second capacitor 44, the misfire detecting means 49 detects that normal combustion has taken place within the cylinder. On the other hand, in the case where normal combustion has not taken place within the cylinder, the voltage applied to the above described first spark plug 52 is maintained at a substantially constant value since ions are not produced when normal combustion does not take place within the cylinder and current does not flow between the center electrode and the outer electrode. The second capacitor 44 divides the voltage across the first capacitor 42 that applies a charge to the first spark plug 52. On the basis of the decay characteristic of the divided voltage produced at the second capacitor 44, i.e., on the basis of the fact that the decay is gradual, the misfire detecting means 49 detects that normal combustion has not taken place within the cylinder.

According to a further aspect of the present invention, the misfire detecting device for the double-ended distributorless ignition system further comprises a first resistor 32 interposed between a line 27 connecting between the ignition coil 26 and the spark plug 52, and the first capacitor 42. When the cylinder provided with the first spark plug 52 is on power stroke, the cylinder provided with the second spark plug 54 is on exhaust stroke. The pressure within the cylinder which is on exhaust stroke is low, so the second spark plug 54 is in the condition of being liable to cause electrostatic breakdown. By the above structure, the first capacitor 42 is charged by way of the first resistor 32 by the high voltage produced at the secondary side of the ignition coil 26. Due to this, by adjusting the resistance of the first resistor 32 and thereby limiting the amount of charge of the first capacitor 42, the voltage across the first capacitor 42 can be limited so as not to cause electrostatic breakdown of the second spark plug 54 associated with the cylinder which is on exhaust stroke.

Alternatively, the first resistor 32 can be interposed between the first capacitor 42 and the second capacitor 44. By this, the high voltage produced at the secondary side of the ignition coil 26 is stored in the first capacitor 42 under the influence of a time constant circuit constituted by the first capacitor 42 and the first resistor 32. Due to this, by adjusting the resistance of the first resistor 32 and thereby limiting the amount of charge of the first capacitor 42, the voltage which the first capacitor 42 applied to the spark plug 52 having finished spark discharge can be set to a desired value.

According to a further aspect of the present invention, the misfire detecting device for the double-ended distributorless ignition system further comprises a diode 34 connected in parallel with the first resistor 32 and in such a manner as to have an anode connected to the first capacitor 42. By this, the high voltage induced at the secondary winding side of the ignition coil 26 is applied to the diode 34 in the reverse direction thereof and is stored in the first capacitor 42 by way of the first resistor 32. On the other hand, the charge stored in the first capacitor 42 passes the diode 34 in the forward direction thereof and thus flows to the first and second spark plugs 52 and 54 without passing through the above described first resistor 32. Due to this, adjustment of the resistance of the first resistor 32 does not cause any influence to current at the time of discharge or firing, so the voltage can be easily set so as not to cause electrostatic breakdown at the spark plug provided to the cylinder on exhaust stroke.

Alternatively, the diode 34 can be connected in parallel with the first resistor 32 and in such a manner as to have a cathode connected to the first capacitor 42, to produce substantially the same effect as above.

According to a further aspect of the present invention, the misfire detecting device for the double-ended distributorless ignition system further comprises a diode 34 and a second resistor 36 interposed between the line 27 and the first capacitor 42 and in parallel with the first resistor 32. By this, even if the diode 34 is shorted, the high voltage produced at the secondary side of the ignition coil 26 is applied by way of the second resistor 36 to the first condenser 42 so that breakdown of the first capacitor 42 never occurs.

Alternatively, the diode 34 and the second resistor 36 can be interposed between the first capacitor 42 and the second capacitor 44 and in parallel with the first resistor 32 to produce substantially the same effect as above.

The above structures are effective for solving the above noted problems inherent in the prior devices.

It is accordingly an object of the present invention to provide a misfire detecting device which is simple in structure and inexpensive but can assuredly detect a misfire in an internal combustion engine provided with a double-ended distributorless ignition system.

It is a further object of the present invention to provide a misfire detecting device of the above described character which can also detect a misfire in an internal combustion engine provided with a single-ended distributorless ignition system assuredly.

DETAILED DESCRIPTION OF THE PREFERRED EMBODIMENTS

Figure 1:
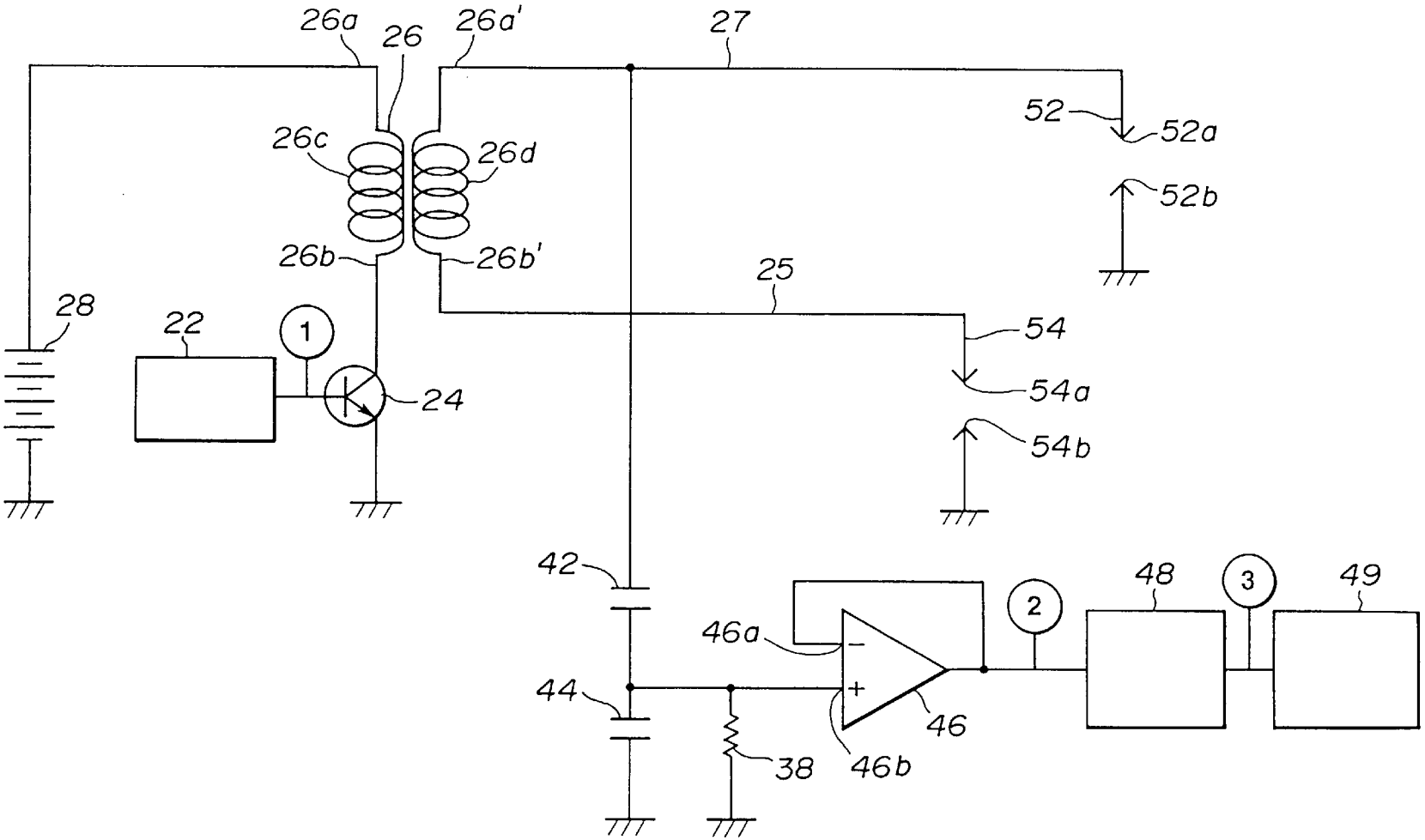
FIG. 1 is a circuit diagram of a misfire detecting device for an internal combustion engine having a double-ended distributorless ignition system according to an embodiment of the present invention.

Referring first to FIG. 1, a misfire detecting device according to an embodiment of this invention is used in a double-ended distributorless ignition system constructed so as to fire two spark plugs, i.e., a positive side spark plug 52 and a negative side spark plug 54 by using one ignition coil 26. The misfire detecting device is used in an eight-cylinder internal combustion engine so that three additional misfire detecting devices, though not shown, are actually provided to the engine. The ignition coil 26 is composed of hundreds of turns of a primary winding 26*c* and tens of thousands of turns of a secondary winding 26*d* which are wound on an iron core. The iron core is formed from a plurality of thin silicon steel plates which are stacked one upon another. The windings are placed in a casing filled with resin (epoxy or the like). The primary winding 26*c* is connected at a positive terminal 26*a* side to a battery 28 and at a negative terminal 26*b* side to a collector of a transistor 24. The transistor 24 is generally called an igniter, and is adapted to have an emitter which is grounded and a base to which a signal from an engine control unit (ECU) 22 is applied. The engine control unit 22 determines an optimum ignition timing on the basis of various signals from an engine speed sensor, coolant temperature sensor, cam position sensor, etc. and delivers a pulse signal toward the transistor 24 so that ignition or firing is performed at the optimum ignition timing.

Further, the positive side terminal 26*a'* of the secondary winding 26*d* of the ignition coil 26 is connected to the center electrode 52*a* of the spark plug 52 by way of a line 27. The outer electrode 52*b* of the positive side spark plug 52 is connected to the ground side by way of a cylinder (not shown). On the other hand, the negative side terminal 26*b'* of the secondary winding 26*b* of the ignition coil 26 is connected to the center electrode 54*a* of the negative side spark plug 54. The negative side spark plug 54 is provided to a cylinder whose phase differs 180 degrees from that of the cylinder to which the above described positive side spark plug 52 is provided, and is connected to the ground side by way of that cylinder. In the meantime, the positive side spark plug 52 and the negative side spark plug 54 are of the same type so as to be interchangeable.

Connected in series to the above described line 27 are a first capacitor 42 of a small capacitance of about 100 picofarads and a second capacitor 44 of a large capacitance of about 10000 picofarads, and the second capacitor 44 is grounded. A junction between the first capacitor 42 and the second capacitor 44 is connected to a noninverting input 46*b* of an operational amplifier 46. The noninverting input 46*b* is grounded by way of a third resistor 38. The operational amplifier 46 applies the output to the inverting input 46*a* and amplifies the signal applied to the noninverting input 46*b* by two or three times. The output of the operational amplifier 46 is applied to a waveform shaping circuit 48 to be processed thereby and then applied to a misfire detecting circuit 49 for making a judgment on whether a misfire has occurred in a cylinder or not on the basis of the signal processed by the waveform shaping circuit 49.

The operation of the misfire detecting device will be described hereinbelow with reference to the waveforms shown in FIGS 11A to 11C. The engine control unit (ECU) 22 produces, as shown at section ① of FIG. 11A which depicts the waveform of a voltage at the portion ① in FIG. 1, a pulse signal "a" at a predetermined timing on compression stroke of the cylinder to which the positive side spark plug 52 is provided. By this, the transistor 24 is turned on to supply (or interrupt) current of several amperes to the primary winding 26*c* of the ignition coil 26 so that a high voltage is induced in the secondary winding 26*d* of the ignition coil 26. This high voltage, as shown in section ② of FIG. 11B which depicts the waveform of a voltage at a circuit portion ② in FIG. 1, builds up to about 10 kilovolts (peak voltage "p") for causing dielectric breakdown and causes a positive potential to be applied to the positive side spark plug 52 to make it perform spark discharge, whilst at the same time causing a negative potential to be applied to the negative side spark plug 54 to make it perform spark discharge. However, the cylinder to which the negative side spark plug 54 is provided is on exhaust stroke. At this time, a charge corresponding to the continuation time of the high voltage and the capacitance of the first capacitor 42 is stored in the first capacitor 42. As indicated by "q" at section ② in FIG. 6, a low voltage of about 1 kilovolt due to arc discharge continues for a while. After completion of the arc discharge, a voltage, which may be called a return voltage or change voltage and is considered as being caused by the interaction of the ignition coil 26 and the discharge of the spark plug 52, builds up once and then decays rapidly. In this instance, the charges stored in the positive side spark plug 52 and the negative side spark plug 54 are coupled again between the positive side and the negative side of the secondary winding 26*d* of the ignition coil 26 and extinguished. However, the positive charge stored in the first capacitor 42 flows into the positive side spark plug 52 and the negative side spark plug 54 such that a voltage is supplied to the both spark plugs. Gradually decaying peak voltages "s1" and "s2" which are resulted from the return voltage and the discharge of the first capacitor 42 are shown in FIGS. 11B and 11C.

Figure 11A:
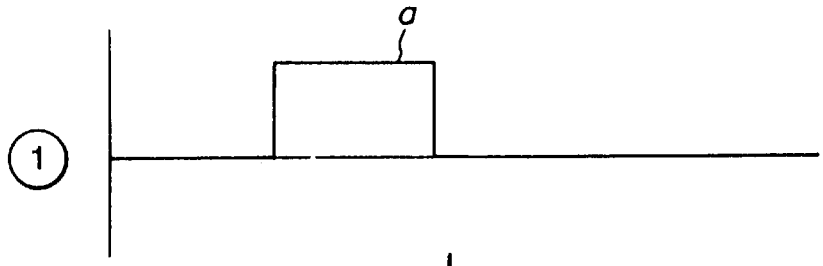
FIGS. 11A to 11C show various waveforms in the misfire detecting devices of FIGS. 1 to 10.
Figure 11B:
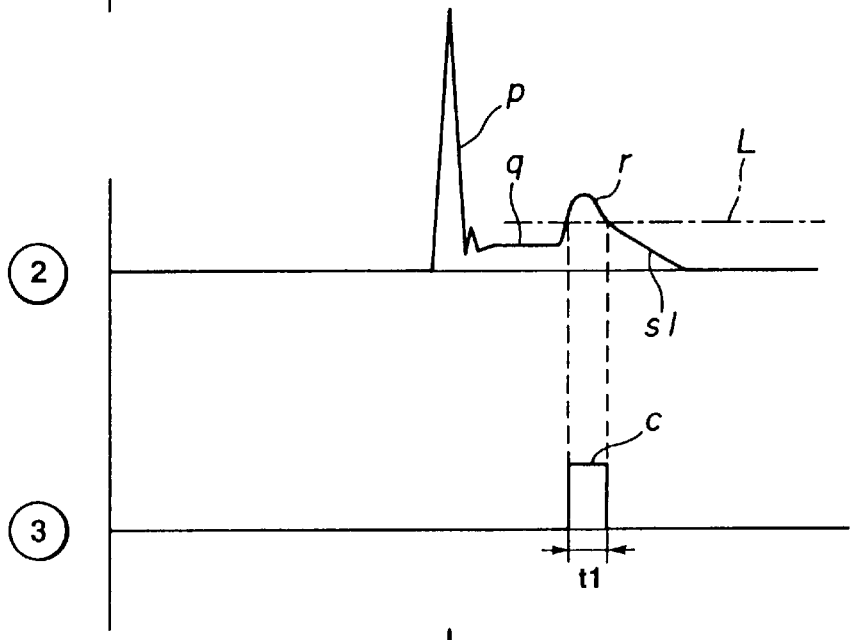
Figure 11C:
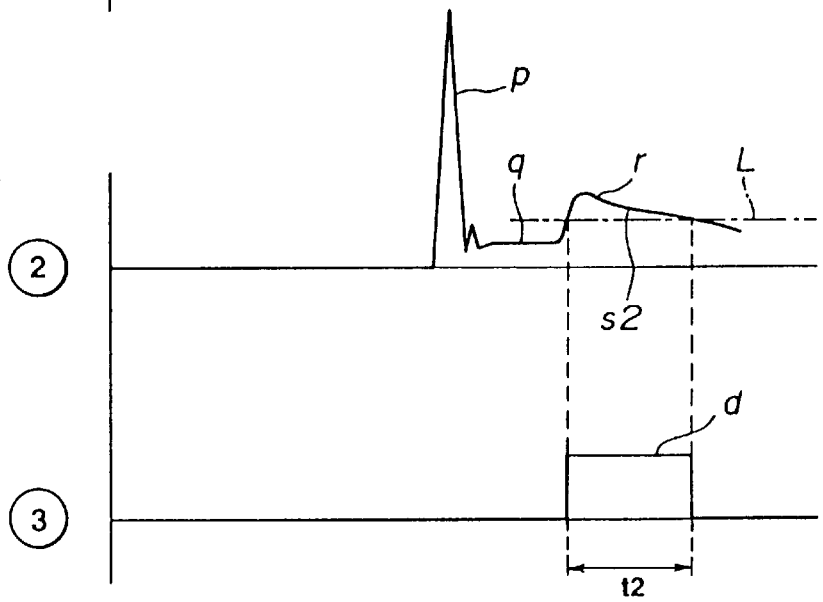
Figure 12:
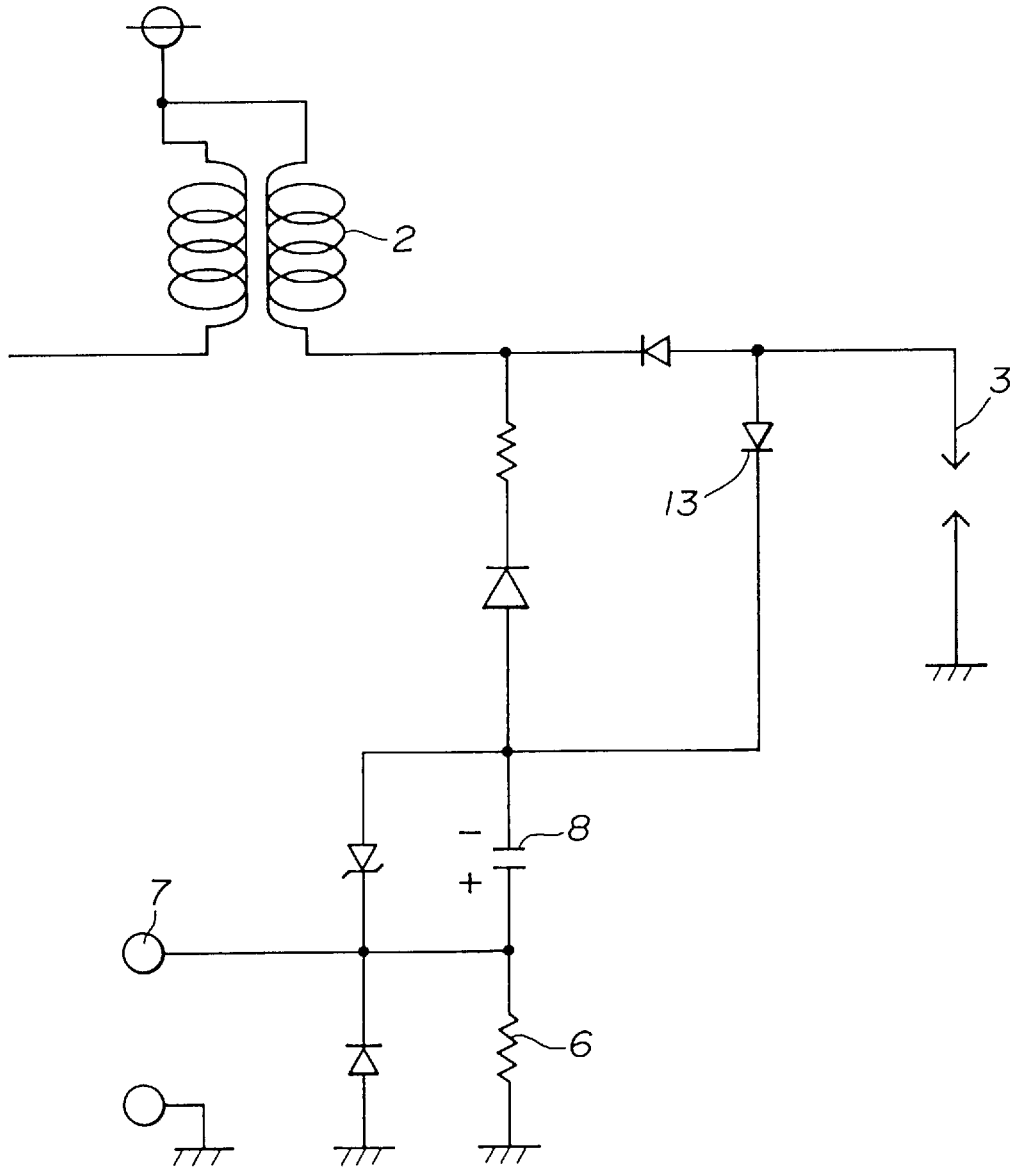
FIG.12 (PRIOR ART)
FIG. 12 is a circuit diagram of a prior art misfire detecting device.

While the capacitance of the first capacitor 42 is set to 100 picofarads, the electrostatic capacity-to-ground of the ignition coil secondary winding side including the positive side spark plug 52, negative side spark plug 54, etc., is about 10 picofarads, so the charge having been stored in the first capacitor 42 is also supplied to the above described electrostatic capacity-to-ground of the secondary winding side, thus causing the gradually decaying peak voltages "s1" and "s2" to drop a little as indicated by "r" in FIGS. 11B and 11C. However, the charge of the first capacitor 42 causes a positive potential to be applied equally to the positive side spark plug 52 to which a positive potential has been applied and the negative side spark plug 54 to which a negative potential has been applied.

In this connection, the gradual peak voltage "s1" represents the case where combustion has taken place at the cylinder on the positive spark plug 52 side. That is, when combustion takes place within a cylinder and ions are produced, the charge from the first capacitor 42 is discharged into the ions and decays rapidly. In this instance, while the charge of the first capacitor 42 is applied to the negative side spark plug 54, the cylinder on the negative spark plug 54 side is on exhaust stroke and therefore does not contain any ion, so the charge is not discharged and the negative spark plug 54 side does not cause any influence to the variation of the charge stored in the first capacitor 42.

The potential of the first capacitor 42 is divided at the second capacitor 44 having an electrostatic capacity of 10000 picofarads which is 100 times of that of the first capacitor 42 to provide a divided potential of 1/100 of the total potential. The divided potential is applied to the noninverting input 46*b* of the operational amplifier 46 to be amplified and is supplied to the waveform shaping circuit 48. The section ② of FIGS. 11B and 11C shows an input waveform supplied to the waveform shaping circuit 48.

Figure 13:
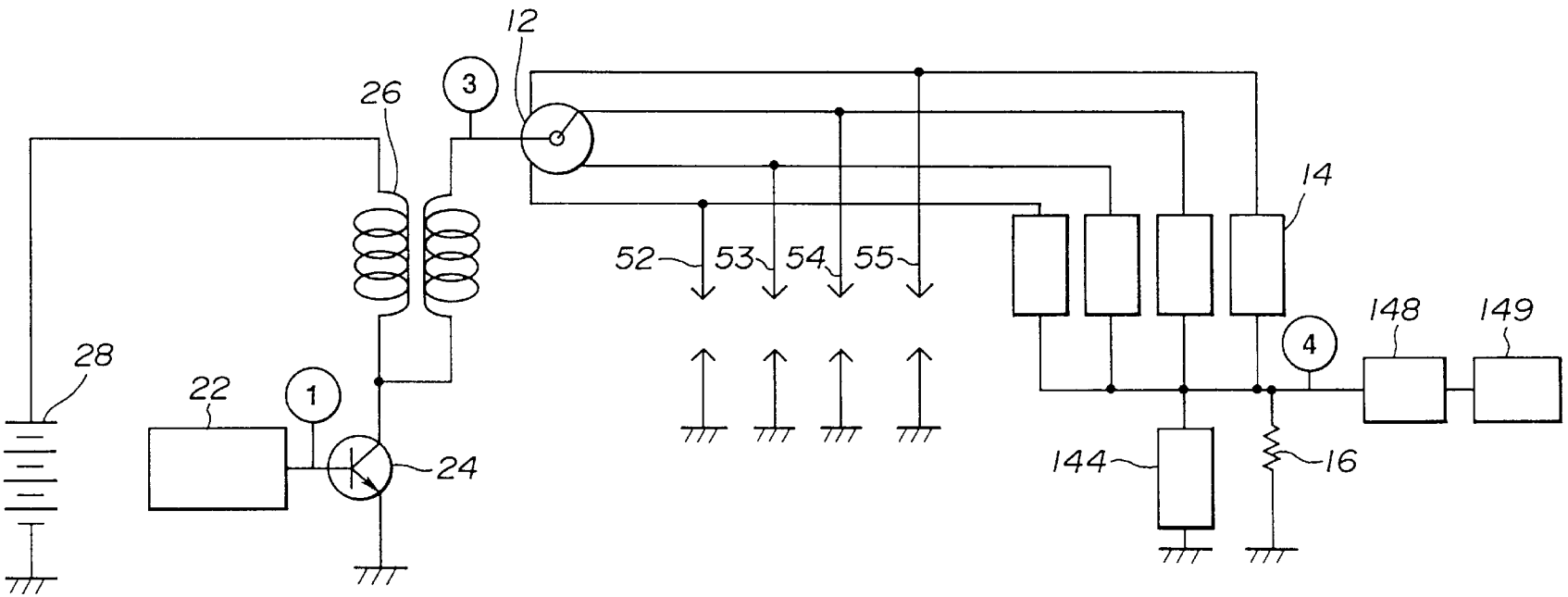
FIG.13 (PRIOR ART)
FIG. 13 is a circuit diagram of another prior art misfire detecting device.
Figure 14A:
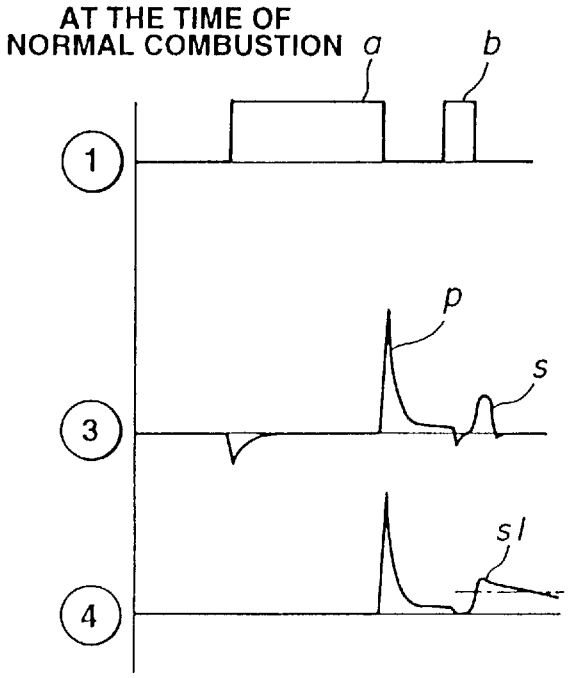
FIGS. 14A to 14C shows various waveforms in the misfire detecting device of FIG. 13.
Figure 14B:
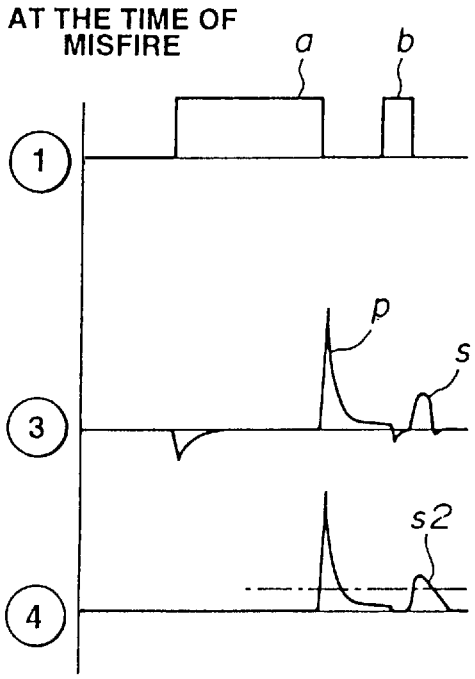
Figure 14C:
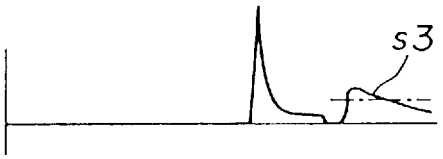
Figure 15:
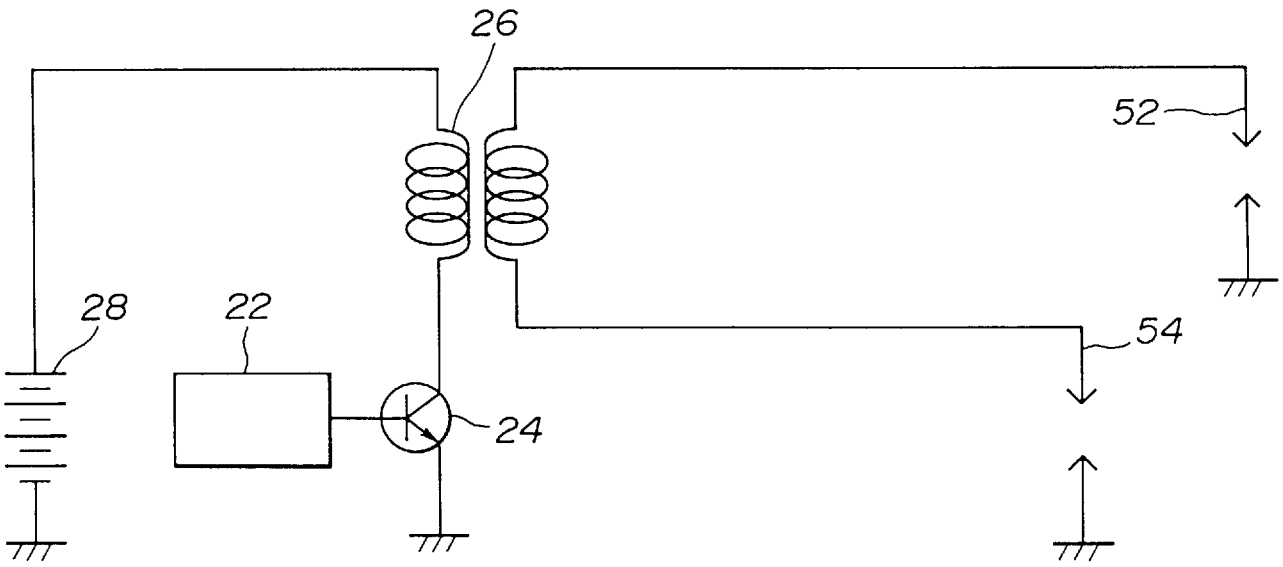
FIG. 15 is a circuit diagram of a double-ended distributorless ignition system.

In FIGS. 11B and 11C, the one-dot chain line indicates a threshold value "L" of the waveform shaping circuit 48. This waveform shaping circuit 48 is designed so as to set the threshold value "L" to 3/5 of the peak value of the gradual peak voltage "s1" or "s2" and outputs a high level signal "c" or "d" in response to a signal voltage exceeding the threshold value "L" (refer to the section ③ of FIG. 6). In the meantime, in the case of the misfire detecting device shown in FIG. 13, the threshold value is set to 2/3 of the peak voltage, whereas in this embodiment the threshold value "L" is set to 3/5 of the peak voltage. This is because at the time of the above described voltage drop of the return voltage the charge stored in the first capacitor 42 is supplied to the electrostatic capacity-to-ground of the secondary winding side so that the gradual peak voltages "s1" and "s2" drop a little as indicated by "r" in FIG. 6 and thereafter discharge by means of the ions is started. For this reason, if the decay or drop at the portion "r" is about 1/3 of the peak value, it becomes impossible to detect whether a misfire has occurred or not, so the threshold value in this embodiment is set to 3/5 of the peak value which is lower than 2/3 of the same. In the meantime, in place of making lower the threshold value "L", the circuit can be designed so as to reset the threshold value at the time of completion of the decay at the portion "r" due to dispersed supply of the charge to the electrostatic capacity-to-ground of the secondary winding side and output a high level signal at the time of input of a signal voltage exceeding 2/3 of the reset value.

In this connection, the gradual peak voltage "s2" represents a decay waveform at the time of a misfire. In this instance, since there is not produced any ion at the time of combustion on the positive spark plug 52 side, so there is not caused any decay due to discharge. In the meantime, similarly to the case where combustion takes place on the positive spark plug 52 side, the cylinder on the negative spark plug 54 side is on exhaust stroke and therefore there is not produced any ion, so the charge is not discharged and the negative spark plug 54 side does not cause any influence to the charge of the positive spark plug 52 side.

In the meantime, the reason why the gradual peak voltage "s2" decays as shown in FIG. 11C on the positive spark plug 52 side where ions are not produced by combustion and discharge does not occur, is that a third resistor 38 of about 1MΩ is connected in parallel to the second capacitor 44. In this connection, the reason why the third resistor 38 is connected in parallel to the second capacitor 44 is firstly because it is intended to supply input bias current to the operational amplifier 46. That is, since the input of the operational amplifier 46 is usually subjected to inputting and outputting of current of about tens of nanoamperes, there is a necessity of providing an electric line or path for preventing the current from flowing into the capacitor. Further, the second reason is that it is intended to relieve the charge stored in the first capacitor 42 and the second capacitor 44. That is, in the complete series capacitor circuit, the voltage stored at the junction is unstable on DC, so when an abnormal charge is stored at the junction for some reason, for example, for reason of static electricity, the voltage across the junction is maintained high for a long time, thus causing a possibility of affecting the detection of the decay waveform. In the meantime, the third resistor 38 is coupled with the first capacitor 42 and the second capacitor 44 to constitute a high-pass filter of time constant of tens milliseconds.

The high level signals "c" and "d" from the waveform shaping circuit 48 are applied to the misfire detecting circuit 49. On the basis of the difference between the continuation time "t1" shown at section ③ (at the time of normal combustion) of FIG. 11B and the continuation time "t2" at section ③ (at the time of misfire), which section ③ depicts the waveform of a voltage at a circuit portion ③ in FIG. 1, the misfire detecting circuit 49 makes a judgment on whether a misfire has occurred. The engine control unit (ECU) 22 reads the result of the judgment as a data on whether a misfire has occurred at the positive side spark plug 52, at a predetermined interruption time after the positive side spark plug is made to perform spark discharge.

Then, the engine control unit 22 produces a pulse signal "a" as shown at section ① of FIG. 11A at a predetermined timing during compression stroke of the cylinder on the negative spark plug 54 side. By this, the transistor 24 is turned on to supply current of several amperes to the primary winding 26*c* of the ignition coil 26, and thereupon a high voltage is induced in the secondary winding 26*d* of the ignition coil 26. This high voltage builds up to about 10 kilovolts (peak voltage "p") for causing dielectric breakdown as shown at section ② of FIGS. 11B and 11C, thus applying a negative potential to the negative side spark plug 54 to make it perform spark discharge and burn the mixture having been compressed in the cylinder. At the same time, a positive potential is applied to the positive side spark plug 52 to make it perform spark discharge. However, the cylinder associated with the positive side spark plug 52 is on exhaust stroke. At this time, a charge corresponding to the continuation time of the high voltage and the capacitance of the first capacitor 42 is stored in the first capacitor 42. Thereafter, by completion of discharge of the both spark plugs, the charges stored in the positive side spark plug 52 and the negative side spark plug 54 are coupled again and extinguished. At this time, the positive charge stored in the first capacitor 42 flows into the positive side spark plug 52 and the negative side spark plug 54 to thereby supply voltage to the both spark plugs.

In this instance, in the case where combustion takes place in the cylinder of the negative spark plug 54 side, the output waveform of the operational amplifier 46 takes the form of the gradual peak voltage "s1" similarly to the above described case. That is, when combustion takes place in the cylinder and ions are produced, the charge from the first capacitor 42 is discharged into the ions and thus decays rapidly. In this connection, the charge of the first capacitor 42 is also supplied to the positive side spark plug 52. However, the cylinder of the positive spark plug 52 side is on exhaust stroke and there is not produced any ion, so the charge is not discharged and there is not caused any influence to the variation of the charge of the first capacitor 42.

On the other hand, in the case where a misfire occurs on the negative spark plug 53 side and there is not produced any ion, a decay due to discharge does not occur so that the output waveform of the operational amplifier 46 takes such a decay waveform of the gradual peak voltage "s2". In this instance, the positive side spark plug 52 which is associated with the cylinder on exhaust stroke does not cause any influence to the charge of the negative spark plug 53 side. And, the gradual peak voltage "s1" or "s2" at the time of combustion or misfire is applied to the waveform shaping circuit 48 which in turn outputs and the high level signal "c" or "d" in response to a signal voltage exceeding the threshold value "L" (refer to sections ③ of FIG. 11B and 11C. On the basis of the difference in time between the high level signals "c" and "d", the misfire detecting device 49 makes a judgment on whether a misfire has occurred. The engine control unit 22 reads the result of judgment as a data on occurrence of misfire at a predetermined interruption time after spark discharge of the negative side spark plug 54.

Figure 2:
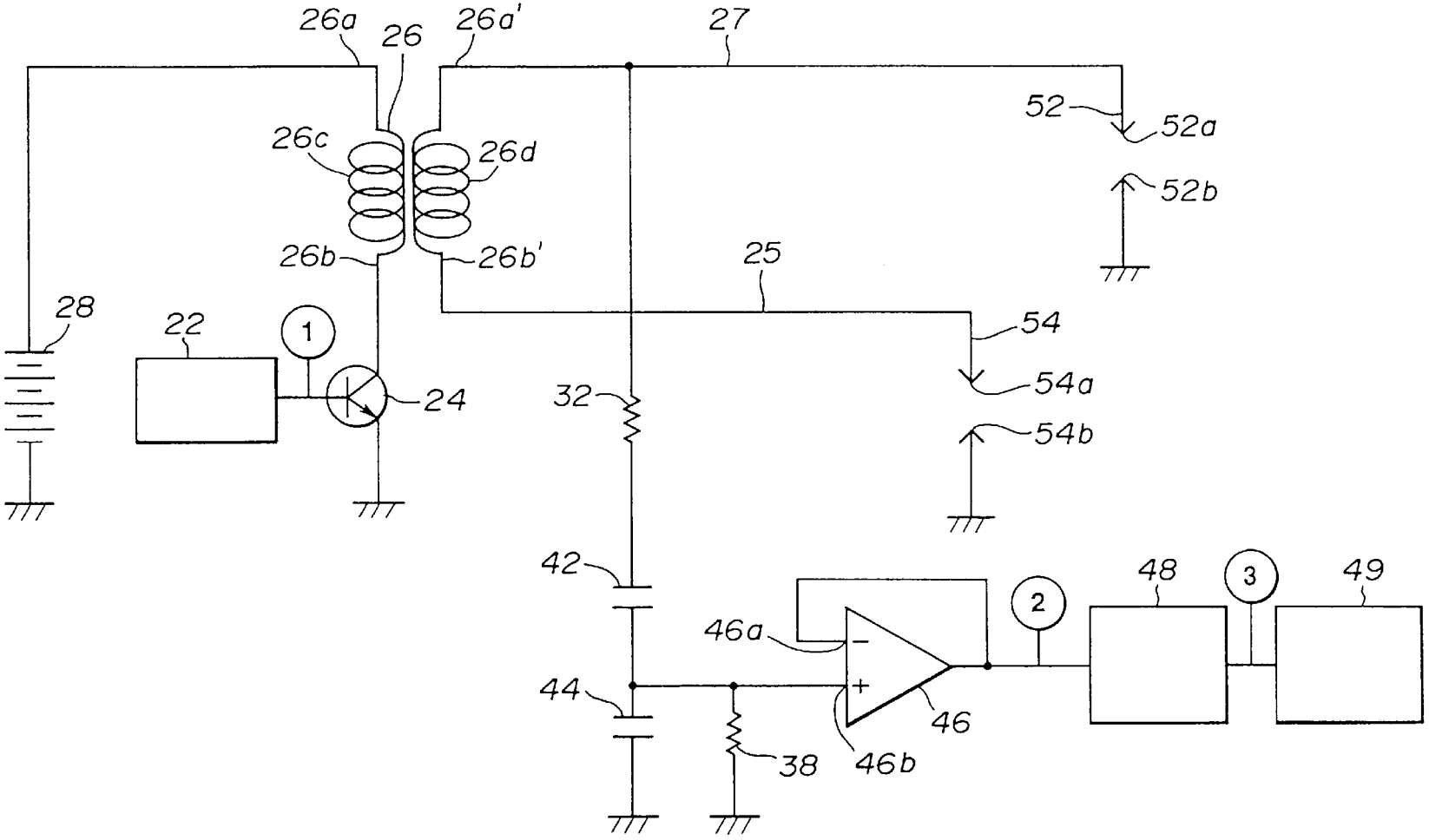
FIG. 2 is a circuit diagram of a misfire detecting device according to another embodiment of the present invention.

Referring to FIG. 2, another embodiment will be described. In this embodiment, similar members to those of the previous embodiment of FIG. 1 are designated by similar reference numerals and repeated description thereto is omitted for brevity.

In this embodiment, a first resistor 32 is interposed between the line 27 connecting between the ignition coil 26 and the positive side spark plug 52 and the first capacitor 42. By this, the amount of charge stored in the first capacitor 42 at the time of discharge of the positive side spark plug 52 and the negative side spark plug 54 can be restricted by the first resistor 32, so the potential applied from the first capacitor 42 to the positive side spark plug 52 and the negative side spark plug 54 can be regulated. Further, the voltage applied to the first capacitor 42 can be suppressed, thus making it possible to protect the first capacitor 42.

In the meantime, in this embodiment, the charge stored in the first capacitor 42 is applied by way of the first resistor 32 to the positive side spark plug 52 having completed spark discharge. The charge having been stored in the first capacitor 42 is supplied to the electrostatic capacity-to-ground of the secondary winding side, whereby the gradual peak voltages "s1" and "s2" drops a little as indicated by "r" and thereafter spark discharge by ions begins. Due to this, in order that the decay indicated by "r" does not become so large, it is necessary to set the capacity of the first capacitor 42 sufficiently large relative to the electrostatic capacity-to-ground of the secondary winding side. However, if the capacity of the first capacitor 42 is set larger than needed, the time constant (CR) based on the capacitance of the fist capacitor 42 and the resistance of the first resistor 32 becomes too large, so it becomes difficult to detect the potential at the time of high engine speed. Accordingly, it is necessary to set the capacitance of the first capacitor 42 and the resistance of the first resistor 32 to optimum values. In the meantime, the operation of the combustion condition detecting device of this embodiment is substantially the same as the pervious embodiment of FIG. 1 so repeated description thereto is omitted for brevity.

Figure 3:
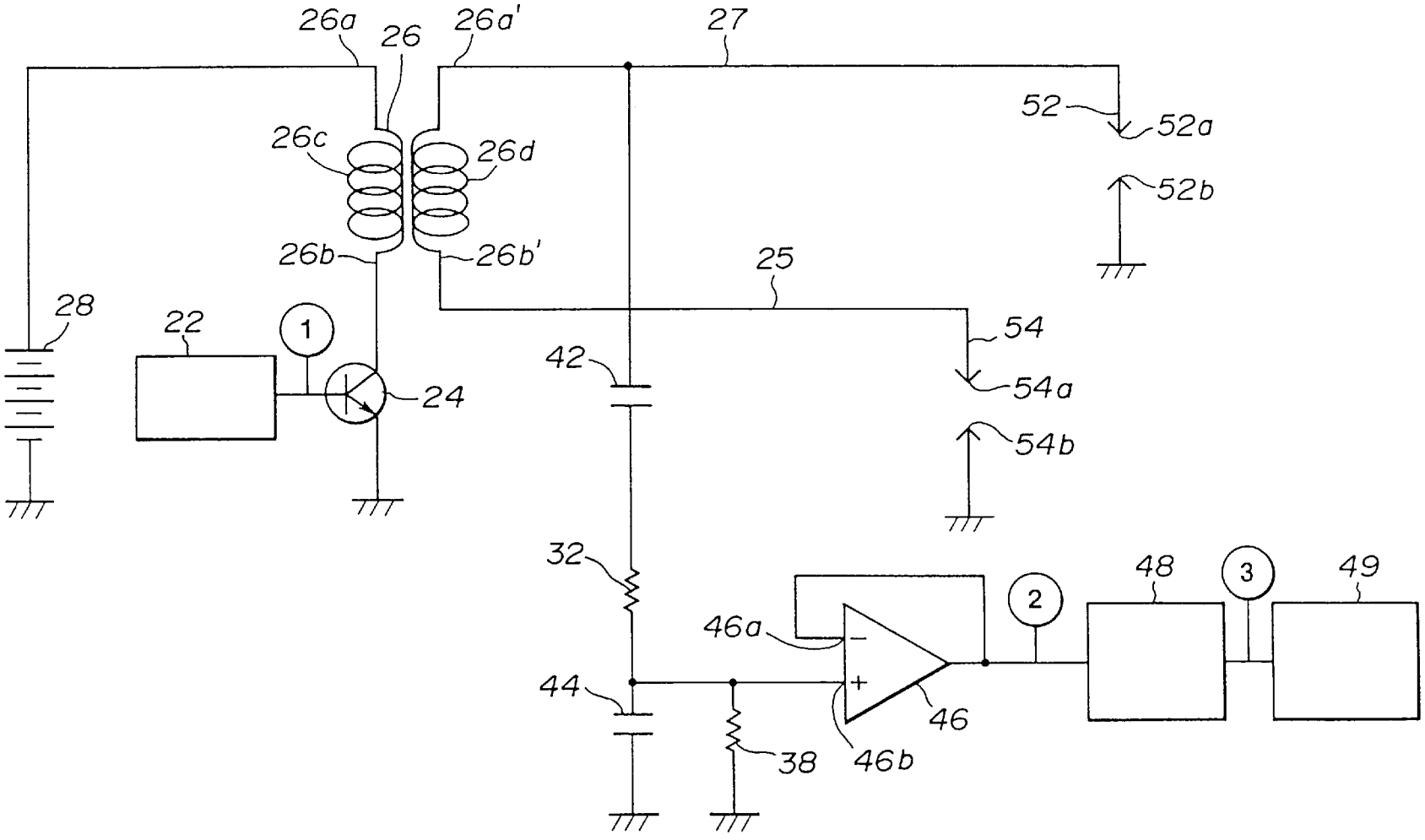
FIG. 3 is a view similar to FIG. 2 but shows a variant of the embodiment of FIG. 2.

Referring to FIG. 3, a variant of the embodiment of FIG. 2 will be described. In the embodiment of FIG. 2, the first resistor 32 is interposed between the line 27 and the first capacitor 42. In contrast to this, in the variant of FIG. 3, the first resistor 32 is interposed between first capacitor 42 and the second capacitor 44. With the circuit of FIG. 3, the high voltage produced at the secondary side of the ignition coil 26 is stored in the first capacitor 42 under the influence of a time constant circuit made up of the first capacitor 42 and the first resistor 32. Due to this, by adjusting the resistance of the first resistor 32 and thereby limiting the amount of charge of the first capacitor 42, the voltage which the first capacitor 42 applies to the spark plug 52 can be set to a desired value.

Figure 4:
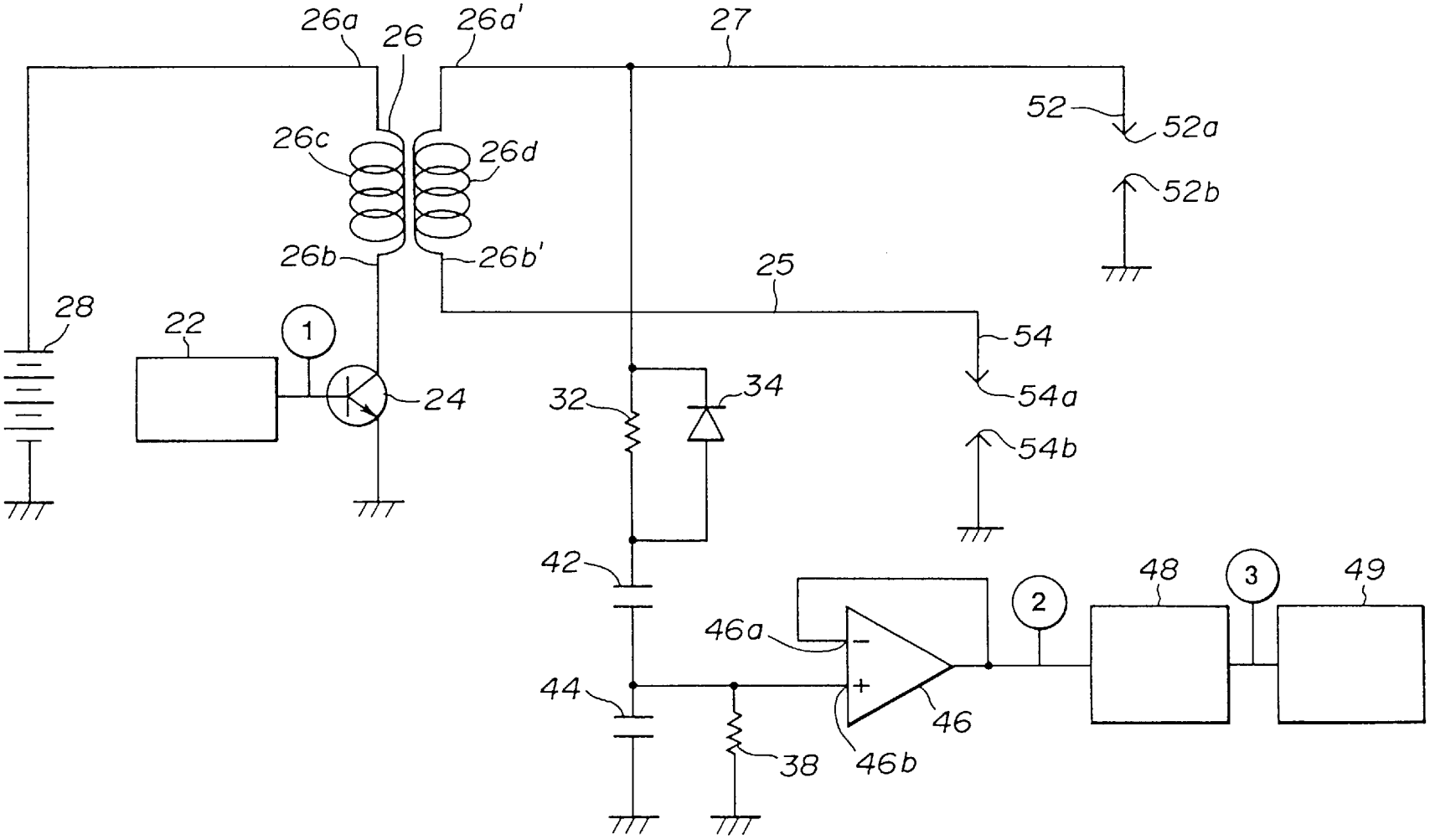
FIG. 4 is a circuit diagram of a misfire detecting device according to a further embodiment of the present invention.

Referring to FIG. 4, a further embodiment will be described. In this embodiment, similar members to those of the embodiment of FIG. 2 are designated by similar reference characters and repeated description thereto is omitted for brevity.

In the previous embodiment of FIG. 2, it is necessary to set the resistance of the first resistor 32 small so as not to obstruct spark discharge by ions. Due to this, during the time in which electrical current flows reversely from the ignition coil 26 into the first capacitor 42 the voltage across the opposite ends of the voltage dividing circuit made up of the first capacitor 42 and the second capacitor 44 builds up at the speed of about the time constant which is determined based on the first resistor 32 and the first capacitor 42, resulting in that the first capacitor 42 is charged up to about the return voltage having been described with reference to FIGS. 11B and 11C. Accordingly, the voltage applied from the first capacitor 42 to the positive spark plug 52 after the spark discharge is extinguished, has the magnitude equal to the above described return voltage or so. Although the voltage is applied equally to the spark plug on the side of the cylinder on compression stroke and to the spark plug on the side of the cylinder on exhaust stroke, dielectric breakdown may possibly be caused on the side of the cylinder on exhaust stroke. That is, since the pressure within the cylinder on exhaust stroke is low, dielectric breakdown occurs at a relatively low potential. The breakdown voltage, particularly when the internal combustion engine is operated at low load, is lowered to about 1 kilovolt. When dielectric breakdown is caused at the spark plug on the side of the cylinder on exhaust stroke and the charge is discharged, the potential at the first capacitor 42 is decayed similarly to the time of combustion even though a misfire is caused at the cylinder on the side of the cylinder on compression stroke, thus disabling to detect the misfire.

On the other hand, in this embodiment of FIG. 4, a diode 34 is arranged so as to be connected in parallel to the first resistor 32 and have the anode on the first capacitor side. The voltage induced in the secondary winding 26*d* of the ignition coil 26 is applied to the cathode of the diode 34, i.e., in the reverse direction thereof and is thus applied by way of the first resistor 32 to the first capacitor 42 to charge the same. On the other hand, when the charge stored in the first capacitor 42 is discharged, it is applied to the diode 34 in the forward direction thereof and thus flows into the positive side spark plug 52 and the negative side spark plug 54 through the diode 34 and not through the above described first resistor 32.

For this reason, the time constant for storage of charge can be set to a large value, i.e., about 10 milliseconds by setting the resistance of the first resistor to about 100MΩ. In this instance, since the discharge time of the ignition system is 1 to 2 milliseconds, the potential rises up to about 1/10 of the return voltage at the most, so it becomes possible to hold down the voltage applied to the spark plug to about 500 volts whereby it becomes possible to prevent discharge due to dielectric breakdown at the cylinder on exhaust stroke. In the meantime, the operation of the combustion condition detecting device of this embodiment is substantially similar to that of the previous embodiment of FIG. 1 so repeated description thereto is omitted for brevity.

Figure 5A:
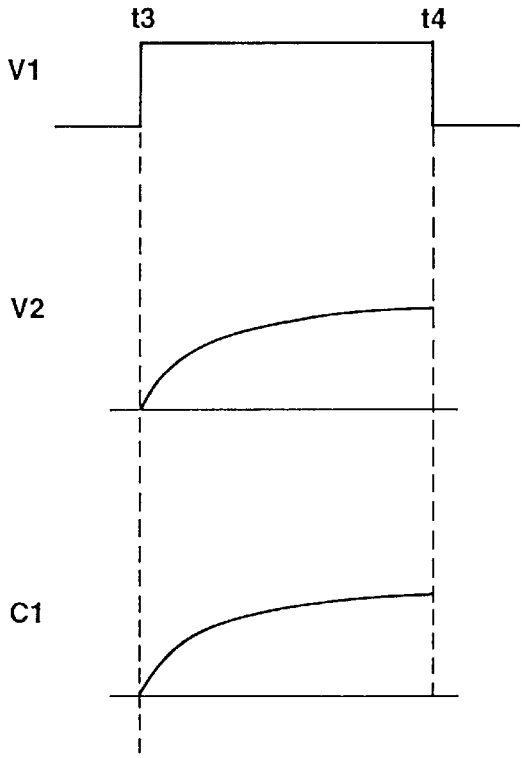
FIGS. 5A and 5B show various waveforms in the misfire detecting device of FIG. 4.
Figure 5B:
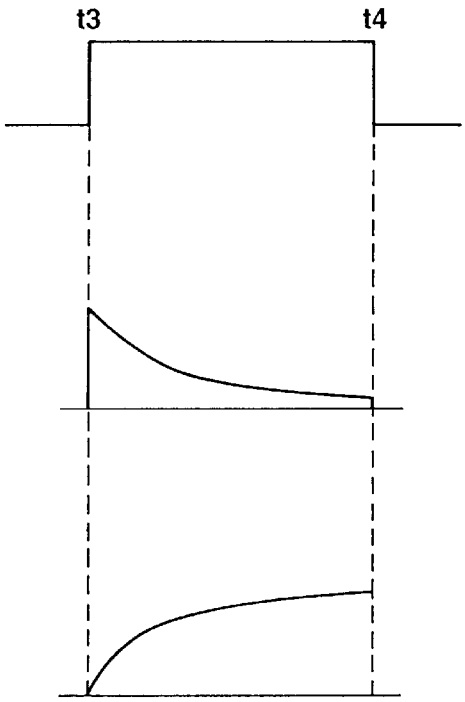
Figure 6:
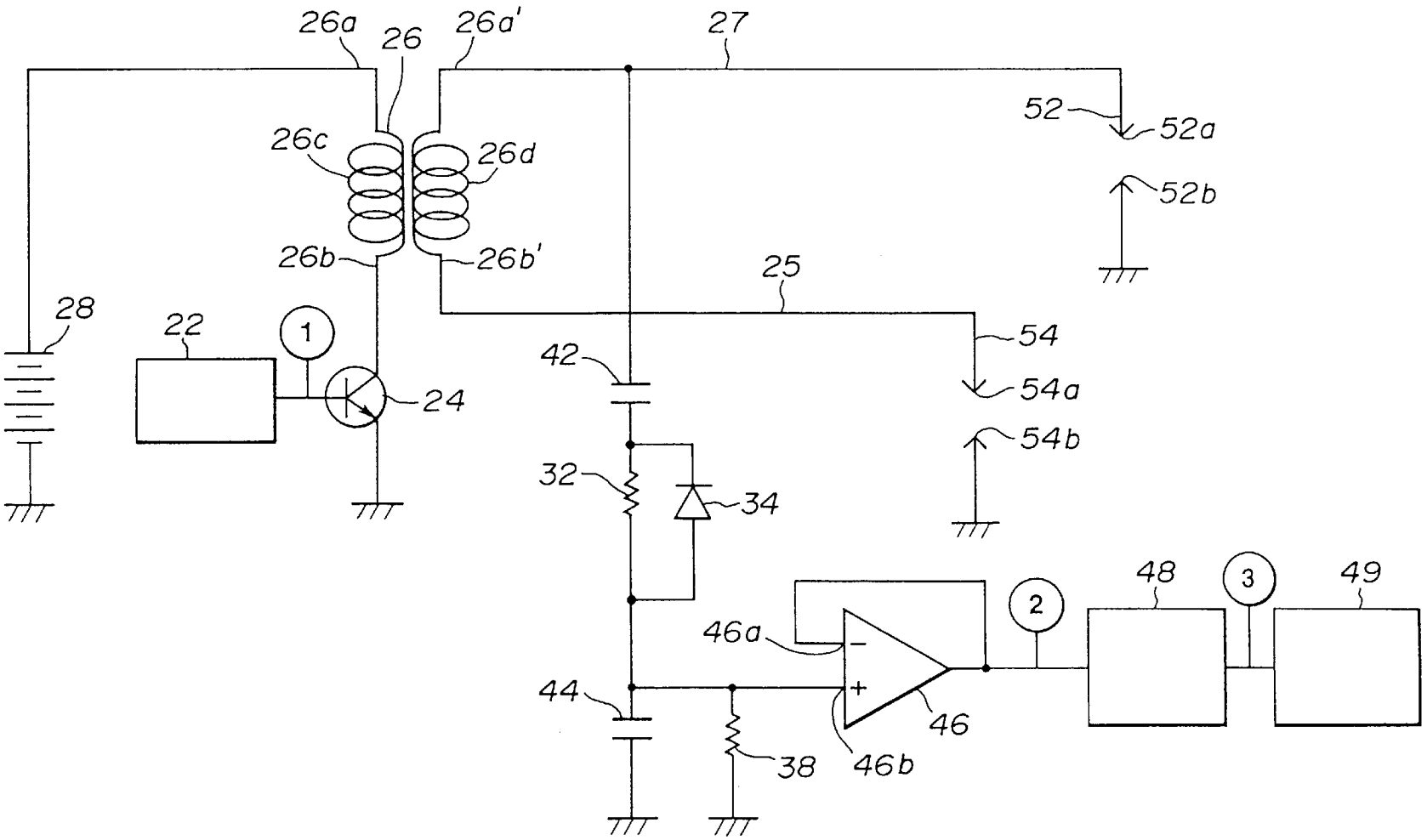
FIG. 6 is a view similar to FIG. 4 but shows a variant of the embodiment of FIG. 4.

FIG. 6 shows a variant of the embodiment of FIG. 4. This variant will be described with additional reference to FIGS. 5A and 5B. In the embodiment of FIG. 4, the first resistor 32 and the diode 34 are interposed between the line 27 and the first capacitor 4. In contrast to this, in this variant, the first resistor 32 and the diode 34 are interposed between the first capacitor 42 and the second capacitor 44.

In this instance, the charge stored in the first capacitor 42 of the circuit of FIG. 4 and the charge stored in the first capacitor 42 of the circuit of FIG. 6 will be described with reference to the waveforms in FIGS. 5A and 5B. FIG. 5A shows waveforms in the circuit of FIG. 4. In this connection, in the case where the high voltage V1 produced at the time t3 at the secondary side of the ignition coil 26 continues until the time t4, the potential at the secondary side of the ignition coil 26 is applied by way of the first resistor 32 so that the potential V2 at the first capacitor 42 increases gradually and in accordance with this also the charge C1 of the same capacitor increases gradually.

FIG. 5B shows waveforms in the circuit of FIG. 6. In this connection, in the case where a high voltage V1 builds up at the time t3 at the secondary side of the ignition coil 26, the potential V2 at the first capacitor 42 to which the high voltage V1 is directly applied, rises abruptly, thereafter drops gradually since flow of a charge occurs by way of the first resistor 32, and falls as indicated by the dotted line in the drawing at the same time t4 when the high voltage V1 across the ignition coil 26 falls. In this instance, since current flows through the diode 34, a potential of a negative polarity is not caused. By the potential V2, the charge C1 of the first capacitor 42 is caused to increase gradually in the manner similar to that shown in FIG. 5A, which is attained by the circuit structure of FIG. 4.

That is, by the circuit structure shown in FIG. 6, the high voltage produced at the secondary side of the ignition coil 26 is stored in the first capacitor 42 in accordance with the time constant circuit made up of the first capacitor 42 and the first resistor 32. Due to this, by adjusting the resistance of the first resistor 32 and thereby limiting the amount of charge of the first capacitor 42, the voltage which the first capacitor 42 applied to the spark plug 52 having completed spark discharge can be set to a desired value.

Figure 7:
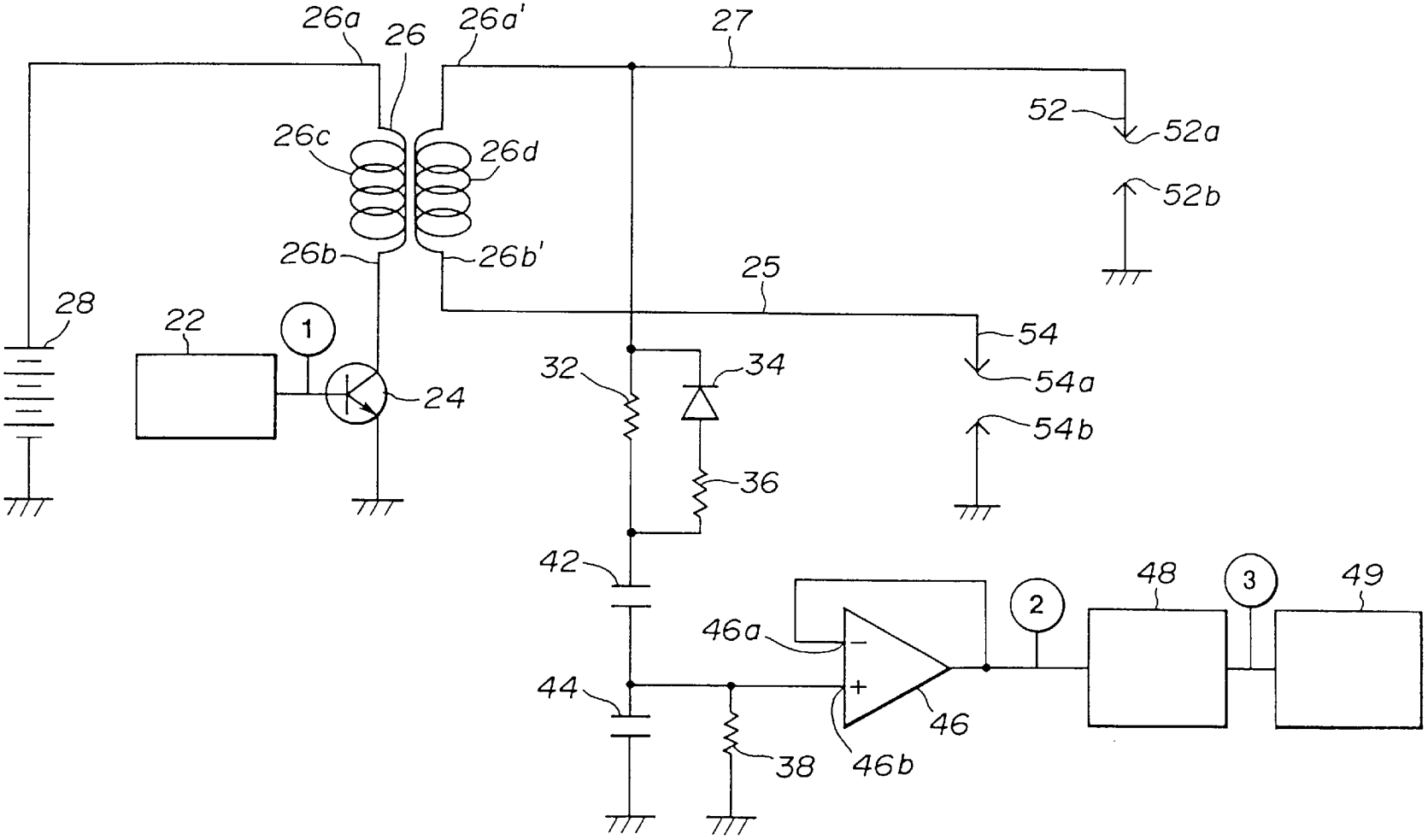
FIG. 7 is a circuit diagram of a misfire detecting device according to a further embodiment of the present invention.

Referring to FIG. 7, a further embodiment will be described. In this embodiment, similar parts to those of the embodiment of FIG. 4 are designated by similar reference characters and repeated description thereto is omitted for brevity.

In the above described embodiment of FIG. 4, when breakdown of the diode 34 is caused, the high voltage induced at the ignition coil 26 is directly applied to the first capacitor 42, so breakdown of the first capacitor 42 may possibly be caused. In this instance, when further the second capacitor 42 is shorted, the secondary side of the ignition coil 26 is shorted to put the positive side spark plug 52 in a condition of being incapable of performing spark discharge. For this reason, in the embodiment of FIG. 4, it is necessary to set the withstand voltage of the first capacitor 42 a little high. However, the capacitor of a high withstand voltage is expensive and large in volume. In each of the above described embodiments for use in a double-ended distirbutorless ignition system, it is desired to install the first resistor 32, diode 34 and first capacitor 42 within the ignition coil 26. However, when the volume of the first capacitor 42 becomes large, it is hard to accommodate those elements within the ignition coil.

On the other hand, in this embodiment of FIG. 7, a second resistor 36 is interposed between the first capacitor 42 and the diode 34, so even if the diode 34 is shorted, the high voltage induced at the secondary side of the ignition coil 26 is applied by way of the first resistor 32 and the second resistor 36 to the first capacitor 42 such that breakdown of the first capacitor 42 is not caused. Further, the potential to be applied to the positive side spark plug 52 is maintained, so it becomes possible to continue spark discharge. The resistance of the second resistor 36 is desirably set to about 1MΩ so as not to cause any obstacle to movement of the charge for detection of ion discharge. In the meantime, in the embodiment of FIG. 7, the resistance of the first resistor 32 is set to be within the range of from 50 to 100MΩ, the capacitance of the first capacitor 42 is set to be within the range of from 200 to 300 picofarads, and the resistance of the second resistor 36 is set to be within the range of from 500 KΩ to 1 MΩ.

By the embodiment of FIG. 7, even if the diode 34 is shorted and the high voltage is applied to the first capacitor 42 to cause breakdown of the first capacitor 42 (high voltage that actually causes a problem is a peak voltage "p" when causing dielectric breakdown of the spark plug, which is shown in FIGS. 11B and 11C and which continues only for a short time so that the probability that breakdown of the first capacitor 42 is caused is low), current flows through the second resistor 36 so that excessively large current does not flow toward the outside. Further, the first resistor 36 can prevent excessively large current to flow in the reverse direction and prevent damage of the diode 34. That is, generally damage of diode is caused mostly when a voltage higher than a reverse withstand voltage is applied in the reverse direction and reverse current more than a predetermined amount flows under such a condition to increase the temperature at the junction beyond a predetermined value and thereby destroy the P-N boundary at the junction (destruction of diode is mostly thermal destruction, so destruction of diode is not caused only by current in the forward direction or by application of excessive voltage in the reverse direction), so by providing the second resistor 36 interposed in place, it becomes possible to prevent reverse current larger than a predetermined amount from being produced. In the meantime, the operation of the misfire detecting device of this embodiment is substantially the same as that of the embodiment of FIG. 1 and repeated description thereto is omitted for brevity.

Figure 8:
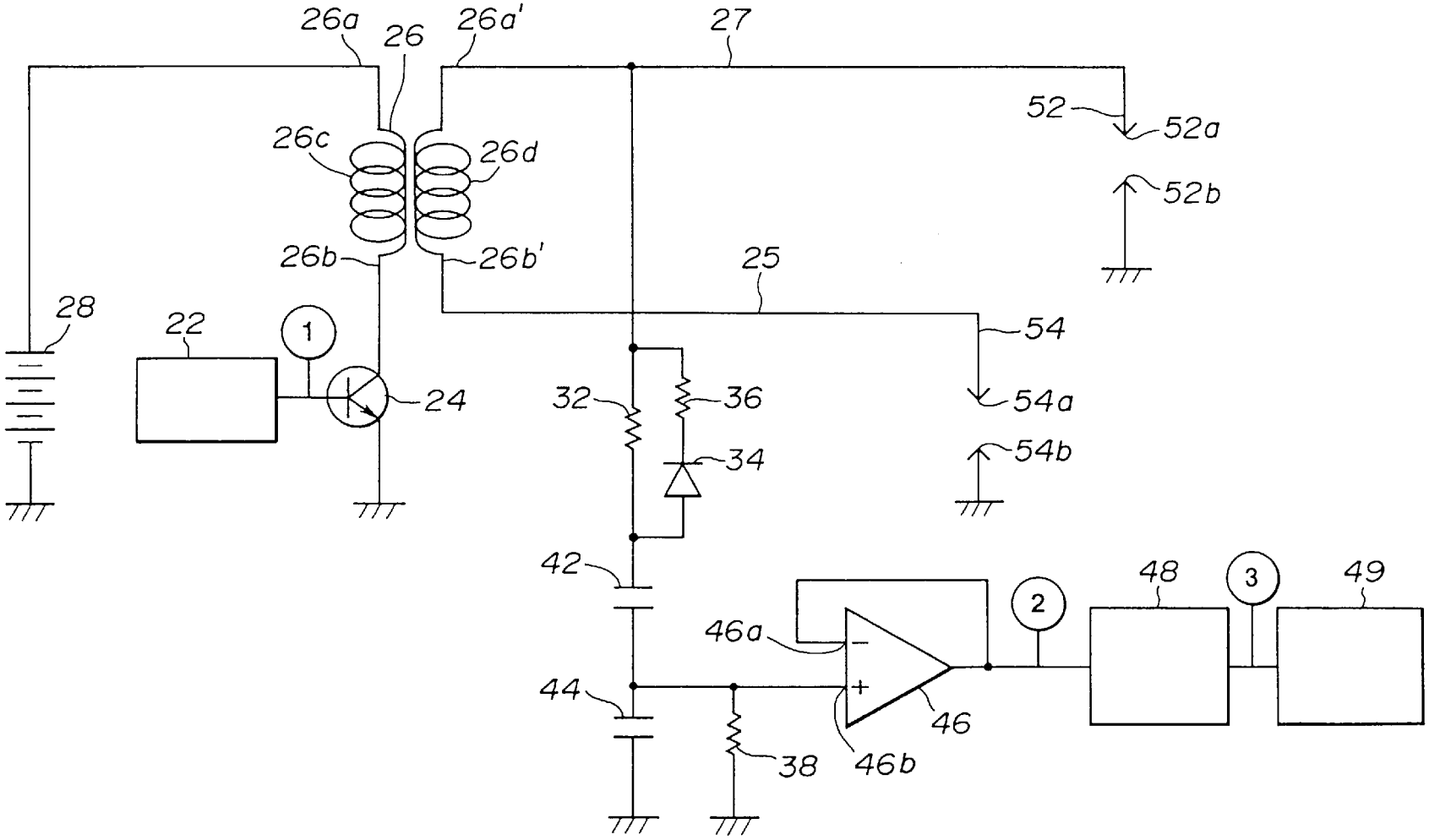
FIG. 8 is a view similar to FIG. 7 but shows a variant of the embodiment of FIG. 7.

Referring to FIG. 8, a variant of the embodiment of FIG. 7 will be described. In the embodiment of FIG. 7, the diode 34 is disposed on the line 27 side, i.e., closer to the line 27, whereas the second resistor 36 is disposed on the second capacitor 44 side, i.e., closer to the second capacitor 44. In contrast to this, in this variant, the second resistor 36 is disposed on the line 27 side, i.e., closer to the line 27, whereas the diode 34 is disposed on the second capacitor 44 side, i.e., closer to the second capacitor 44. That is, although as shown in FIG. 8, the second resistor 36 and the diode 34 are disposed in a reverse order in respect to that of the embodiment of FIG. 7, this variant can produce substantially the same effect as the embodiment of FIG. 7.

Figure 9:
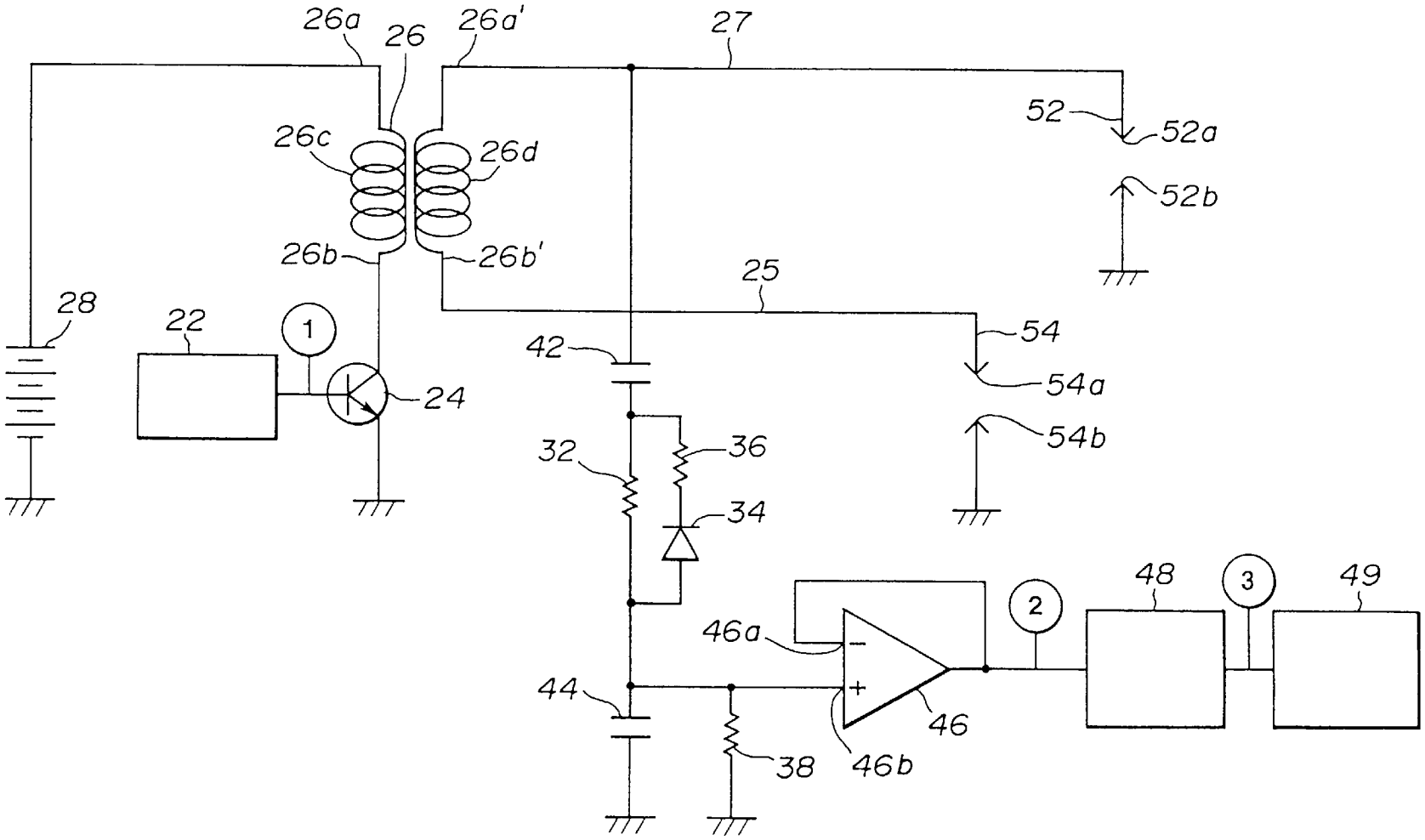
FIG. 9 is a view similar to FIG. 7 but shows another variant of the embodiment of FIG. 7.

Referring to FIG. 9, another variant of the embodiment of FIG. 7 will be described. In the embodiment of FIG. 7, the first resistor 32, diode 34 and the second resistor 36 are disposed on the line 27 side of the first capacitor 42, i.e., closer to the line 27 than the first capacitor 42. In contrast to this, in the variant of FIG. 9, the first resistor 32, diode 34 and the second resistor 36 are disposed between the first capacitor 42 and the second capacitor 44. The circuit according to the variant can produce substantially the same effect as the embodiment of FIG. 7.

Figure 10:
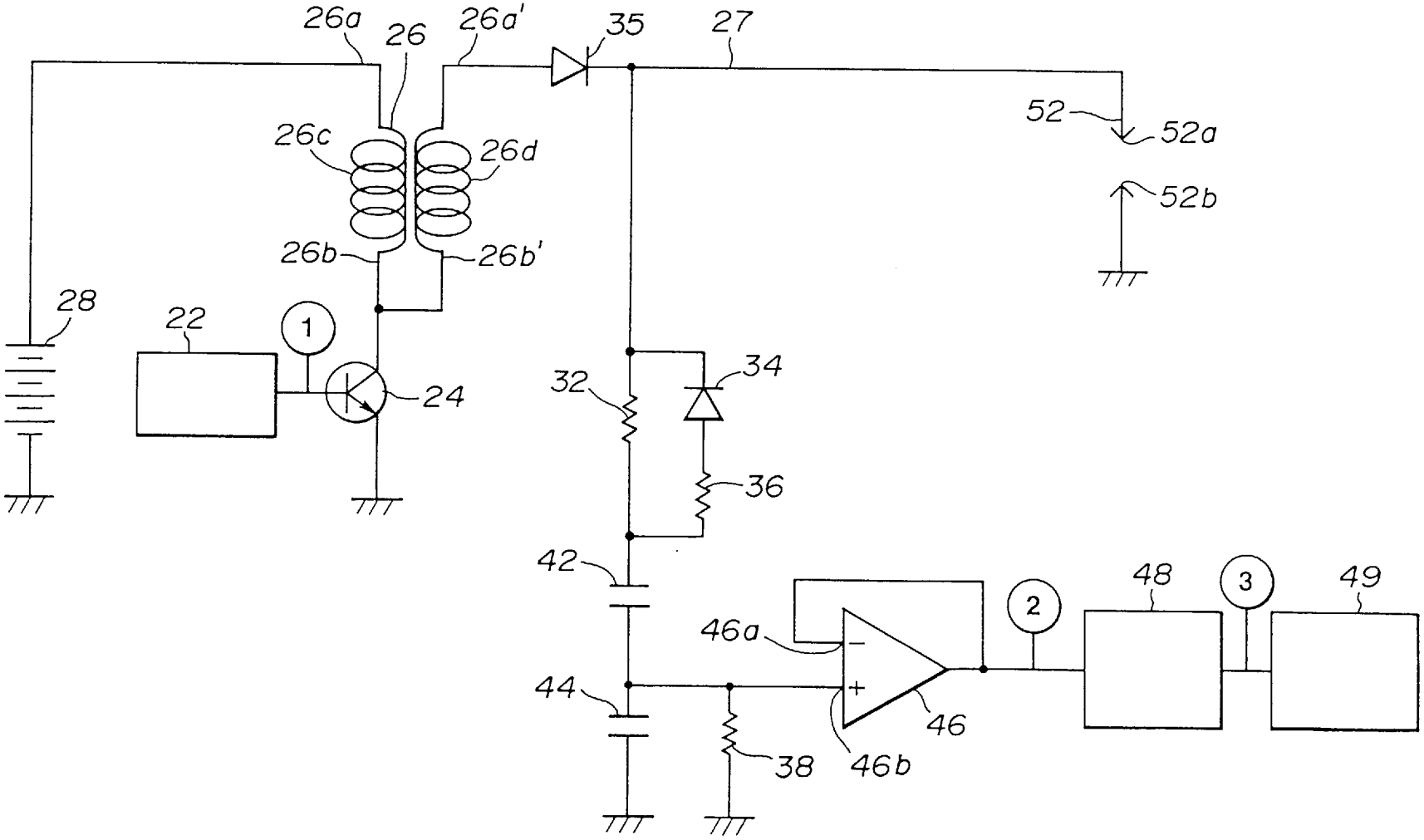
FIG. 10 is a circuit diagram of a misfire detecting device for an internal combustion engine having a single-ended distributorless ignition system according to a further embodiment of the present invention.

Referring to FIG. 10, a further embodiment will be described. In this embodiment, similar parts to those of the embodiment of FIG. 4 are designated by similar reference characters and repeated description thereto is omitted for brevity. In the above described embodiments of FIGS. 1 to 4 and 6 to 9, the misfire detecting device of this invention has been described and shown as being applied to a double-ended distributorless ignition system. In contrast to this, in this embodiment, it is applied to a single-ended distributorless ignition system. In the meantime, the misfire detecting device of this embodiment is applied to an eight-cylinder internal combustion engine, so though not shown, seven other misfire detecting devices are actually installed on the engine.

In this embodiment, the positive side of the secondary winding 26*d* of the ignition coil 26 is connected to the positive side spark plug 52 to make the positive side spark plug 52 perform spark discharge. The potential applied to the positive side spark plug 52 is stored in the first capacitor 42 so that a voltage is applied to the positive side spark plug 52 having completed spark discharge to carry out detection of a misfire. A diode 35 is interposed between the first capacitor 42 and the positive side of the secondary winding 26*d* so as to prevent current flowing back through the ignition coil 26 to the battery 28. In this embodiment, as having been described with respect to the embodiment of FIG. 4, the voltage which is applied from the first capacitor 42 to the positive side spark plug 52 is adjusted to about 500 volts. With the prior art structure, there occurred a case, though rarely, in which when a misfire was caused at the cylinder on compression stroke, dielectric breakdown was caused by application of a voltage amounting to about the above described return voltage to disable detection of the misfire. In contrast to this, in this embodiment, it becomes possible to apply to the positive side spark plug 52 a voltage which is so low as not to cause dielectric breakdown, thus making it possible to detect a misfire assuredly.

In the meantime, while in the above described embodiments, the present invention has been described with respect to the examples applied to double-ended and single ended distributorless ignition systems, it can be applied to distributor type ignition systems.

From the foregoing, it will be understood that by a misfire detecting device for an internal combustion engine according to the present invention, it becomes possible to assuredly detect a misfire in a double-ended distributorless ignition system with a cheap and simple structure.

It will be further understood that a misfire detecting device of this invention can also detect a misfire in a single-ended distributorless ignition system assuredly.

What is claimed is:

1. A misfire detecting device for an internal combustion engine provided with a double-ended distributorless ignition system including an ignition coil having a primary winding and a secondary winding, primary current interrupting means for interrupting flow of battery current through the primary winding of the ignition coil, a first spark plug connected at a center electrode side thereof to a positive side of the secondary winding and grounded at an outer electrode side thereof, and a second spark plug connected at a center electrode side thereof to a negative side of the secondary winding and grounded at an outer electrode side thereof, the misfire detecting device comprising:

a first capacitor connected to a side of the secondary winding of the ignition coil opposite from the side to which the second spark plug is connected to and in parallel with the first and second spark plugs, said first capacitor being charged by a voltage produced at the secondary winding side of the ignition coil and thereafter applying a voltage to the first and second spark plugs when a voltage at the secondary winding side drops;

a second capacitor connected in series with said first capacitor and having a capacitance larger than that of said first capacitor to divide a voltage across said first capacitor; and misfire detecting means connected to a junction between said first capacitor and said second capacitor to detect a misfire on the basis of a decay characteristic of a divided voltage produced at said second capacitor.

2. The misfire detecting device according to claim 1 further comprising a first resistor interposed between a line connecting the ignition coil and the first spark plug, and said first capacitor.

3. The misfire detecting device according to claim 1 further comprising a first resistor interposed between said first capacitor and said second capacitor.

4. The misfire detecting device according to claim 2, further comprising a diode connected in parallel with said first resistor, an anode of said diode being connected to said first capacitor.

5. The misfire detecting device according to claim 3, further comprising a diode connected in parallel with said first resistor, a cathode of said diode being connected to said first capacitor.

6. The misfire detecting device according to claim 2, further comprising a diode and a second resistor, both of which are interdisposed between said line and said first capacitor and in parallel with said first resistor.

7. The misfire detecting device according to claim 3, further comprising a diode and a second resistor, both of which are interdisposed between said first capacitor and said second capacitor and in parallel with said first resistor.

8. A double-ended distributorless ignition system for generating voltage signals indicative of a misfire in an internal combustion engine, comprising:

an ignition coil having a primary winding and a secondary winding in which a voltage is induced in response to a battery current through the primary winding;

a first spark plug connected at a center electrode side thereof to a positive side of the secondary winding and grounded at an outer electrode side thereof;

a second spark plug connected at a center electrode side thereof to a negative side of the secondary winding and grounded at an outer electrode side thereof;

a first capacitor connected to a positive side of the secondary winding of the ignition coil and in parallel with the first and second spark plugs, said first capacitor being charged by the voltage induced in the secondary winding and thereafter applying a voltage to the first and second spark plugs when a voltage in the secondary winding drops; and a second capacitor connected in series with said first capacitor and having a capacitance larger than that of said first capacitor, the second capacitor dividing a voltage across said first capacitor and producing the voltage signals indicative of a misfire in the internal combustion engine.

9. The double-ended distributorless ignition system according to claim 8, further comprising a first resistor interposed between a line connecting the ignition coil and the first spark plug, and said first capacitor.

10. The double-ended distributorless ignition system according to claim 9, further comprising a diode connected in parallel with said first resistor, an anode of said diode being connected to said first capacitor.

11. The double-ended distributorless ignition system according to claim 9, further comprising a diode and a second resistor, both of which are interdisposed between said line and said first capacitor and in parallel with said first resistor.

12. The double-ended distributorless ignition system according to claim 8, further comprising a first resistor interposed between said first capacitor and said second capacitor.

13. The double-ended distributorless ignition system according to claim 12, further comprising a diode connected in parallel with said first resistor, a cathode of said diode being connected to said first capacitor.

14. The double-ended distributorless ignition system according to claim 12, further comprising a diode and a second resistor, both of which are interdisposed between said first capacitor and said second capacitor and in parallel with said first resistor.

15. The misfire detecting device according to claim 1, wherein the first and second capacitors are not connected to the primary winding.

16. The misfire detecting device according to claim 2, wherein the first and second capacitors are not connected to the primary winding.

17. The misfire detecting device according to claim 3, wherein the first and second capacitors are not connected to the primary winding.

* * * * *

UNITED STATES PATENT AND TRADEMARK OFFICE

CERTIFICATE OF CORRECTION

PATENT NO. : 5,828,217

DATED : October 27, 1998

INVENTOR(S) : Hiroshi INAGAKI *et al.*

It is certified that error appears in the above-identified patent and that said Letters Patent is hereby corrected as shown below:

On the title page,

Item [56] References Cited under U.S. Patent Documents, please insert

--5,363,046 11/1994 Shimasaki et al.--.

Item {56] References Cited under Foreign Patent Documents, please insert

--0 513 996 11/1992 Europe
0 519 588 12/1992 Europe
0 272 225 06/1988 Europe
0 508 804 10/1992 Europe--.

Signed and Sealed this

First Day of June, 1999

*Attest:*

Q. TODD DICKINSON

*Attesting Officer*

*Acting Commissioner of Patents and Trademarks*